United States Patent [19]

Smith et al.

[11] Patent Number: 4,789,522

[45] Date of Patent: Dec. 6, 1988

[54] CASTABLE ZINC-ALUMINUM ALLOYS

[75] Inventors: Reginald W. Smith; Mansor Ghoreshy, both of Kingston, Canada

[73] Assignee: Queen's University at Kingston, Kingston, Canada

[21] Appl. No.: 133,832

[22] Filed: Nov. 24, 1987

Related U.S. Application Data

[63] Continuation-in-part of Ser. No. 879,572, Jun. 27, 1986, abandoned.

[51] Int. Cl.[4] ..... C22C 18/04

[52] U.S. Cl. ..... 420/514; 164/57.1; 420/416; 420/515; 420/519; 420/516

[58] Field of Search ..... 420/514, 515, 516, 416, 420/519; 164/57.1

[56] References Cited

U.S. PATENT DOCUMENTS

| | | | |
|---|---|---|---|
| 4,448,748 | 5/1984 | Radtke et al. | 420/514 |
| 4,609,529 | 9/1986 | Skenazi et al. | 420/516 |
| 4,722,871 | 2/1988 | Radtke | 420/514 |

*Primary Examiner*—John P. Sheehan
*Assistant Examiner*—Robert L. McDowell
*Attorney, Agent, or Firm*—Richard J. Hicks

[57] ABSTRACT

An improved castable hypereutectic zinc-aluminum alloy which is free from underside shrinkage is described. Small additions, from about 0.25% and up to about 2 wt% of rare earth metal, preferably in the form of misch metal, to known zinc-aluminum alloys containing from about 20% and up to about 40 wt% aluminum have been found to prevent underside shrinkage in castings with a cross section up to about six inches.

8 Claims, No Drawings

CASTABLE ZINC-ALUMINUM ALLOYS

CROSS REFERENCE TO RELATED APPLICATIONS

This application is a continuation-in-part of our earlier filed application U.S. Ser. No. 879,572 filed June 27, 1986, now abandoned.

FIELD OF INVENTION

This invention relates to zinc-aluminum alloys and more particularly castable hypereutectic zinc-aluminum alloys containing from about 20% and up to about 40% aluminum.

BACKGROUND OF INVENTION

Over the past few years considerable efforts have been expended in developing a family of zinc-aluminum alloys for structural purposes. Zinc-aluminum alloys find wide engineering application and may be attractive alternatives to cast iron, steel, and copper-base alloys. Interest has focused in recent years on hypereutectic alloys containing 8%, 11%, 27% and 35% aluminum respectively and designated ZA8, ZA11, ZA27 and ZA35. The zinc-aluminum eutectic composition is about Zn 5.1% Al. All of these alloys are relatively high strength ductile alloys which can be used in wrought condition. Those alloys close to the eutectic composition can also be used in the cast condition in a relatively heavy section but it has been found that, as the percentage of aluminum increases, a problem known as "underside shrinkage" increases. That is to say, instead of the normal shrinkage pipe at the top of the ingot or casting, a shrinkage cavity appears at the bottom of the ingot or casting. Normally shrinkage pipes are controlled by the use of hot tops or additions of hot metal, but of course these techniques are of no value in controlling underside shrinkage. Some alleviation of the problem, if it is not too severe, can be obtained by the use of chilled moulds but in the higher aluminum alloys even this technique is insufficient to remove the underside shrinkage cavity and this defect does, of course, limit the size of section which can be soundly cast. Prior attempts to solve the shrinkage problem by modifying the alloy composition by including such additions as 0.02–0.2 wt% of Groups IIa or Ia alkaline earth metals such as barium, calcium and strontium or lithium, sodium and potassium have not been particularly successful as the results of such additions have not been found to be always reproducible (M. Sahoo, L. V. Whiting and D. W. G. White, "Control of Underside Shrinkage in Zinc-Aluminum Foundry Alloys by the Addition of Trace Elements", Minerals Research Program, PMRL Division Report MRP/PMRL 84–86 (OP-J)).

Low aluminum-zinc alloys (generally recognized to contain from about 3% to about 15% aluminum) containing additions from about 5 ppm to about 1% of a rare earth containing alloy, for use as hot-dip galvanizing alloys are known (see, for example, U.S. Pat. No. 4,448,748 issued May 15, 1984 to Radtke et al. and assigned to the International Lead Zinc Research Organization Inc.) but there has been no suggestion that such alloys may be cast without underside shrinkage.

Grain refining amounts of misch metal of the order of 0.05 wt% in Zn 27 Al alloys have also been described (Metall. 37 Jahrgang. Heft 9. September 1983), but here again the amounts of misch metal added is insufficient to remedy the problem of underside shrinkage. Grain refining amounts of Ce or La between 5 ppm and 0.1 wt% are known to improve ductility of Zn 27 Al alloys without adversely affecting the tensile strength (U.S. Pat. No. 4,609,529 issued Sept. 2, 1986 to Skenazi et al.).

OBJECTS OF INVENTION

It is therefore, one object of the present invention to provide a method for controlling underside shrinkage in zinc-aluminum alloy castings, containing relatively large amounts of aluminum of the order of 20 wt% or more, and more particularly in zinc 27% aluminum alloys.

Another object of the invention is to provide novel zinc-aluminum alloy compositions which are suitable for use in relatively heavy cast sections. Thus, in fulfillment of these objects there is provided, by one aspect of this invention, a method for controlling underside shrinkage in a cast hypereutectic zinc-aluminum alloy containing at least 20% aluminum comprising melting said alloy and adding thereto at least one rare earth metal in an amount from 0.26–2.0 wt% and sufficient to substantially eliminate underside shrinkage when said alloy is cast into a sand mould having a cross section of at least one inch.

By another aspect of this invention there is provided a castable, hypereutetic zinc-aluminum alloy consisting essentially of:

at least 20 wt% to about 40 wt% aluminum
from 0.25 wt% to 2 wt% of at least one rare earth metal
up to 5.0 wt% Cu
up to 1.0 wt% Si
up to 0.1 wt% Mg
balance zinc and incidental impurities.

DETAILED DESCRIPTION OF PREFERRED EMBODIMENTS

As noted above, Zn alloys containing up to 15% Al max. and also up to about 1% misch metal are used in zinc-containing hot-dip metal baths to provide high quality protective coatings free of defects such as bare spots. While a protective coating may be considered as a casting it is, by definition, a very thin casting and the problem of underside shrinkage cavities associated with heavy castings having a cross section of up to, say, six inches has not even been contemplated. Without wishing to be bound by this explanation, it is believed that during the solidification of heavy section zinc-aluminum castings considerable segregation takes place due to the considerable difference in density between the zinc-rich and aluminum-rich phases. The relatively lighter aluminum-rich phase, usually in the form of dendrites, rises to the upper part of the casting upon solidification, due to the higher melting point of aluminum (658° C.) relative to zinc (410° C.), and the heavier zinc-rich liquid sinks to the bottom, solidifying after the upper layers so that there is no reservoir of liquid to replenish the shrinkage cavity as it arises during the further solidification of the casting. It has now been found that addition of small amounts of rare earth metals not only act as a scavenger for oxygen but also provide nucleation sites throughout the liquid metal so that solidification takes place with reduced segregation.

As will be appreciated by those skilled in the art, the term "misch metal" refers to a variety of known rare earth metal alloys which are typically either cerium or lantanum rich. One known series comprises (in weight %):

Ce 45–60; other rare earths 35–50, balance Fe, Mg, Al, Si and impurities.

Another known series comprises (in weight %):

La 60–90; Ce 8.5, Nd 6.5; Pr 2 balance Fe, Mg, Al and Si.

One specific misch metal contemplated and used in the present invention, comprises:

Ce 50; La 38; Nd 4; Pr 4; other rare earths 1; balance Fe, Mg, Al and Si.

It will also be appreciated by those skilled in the art that pure rare earth metals, such as cerium, may also be used in the present invention but would not normally be selected in view of the cost in relation to the relatively inexpensive and readily available misch metal alloys.

The amount of misch metal to be added to the alloy depends, in part, on the amount of aluminum present. The higher the aluminum content the greater the misch metal addition should be to ensure complete removal of undeside shrinkage. Thus, the amount may vary from about 0.25% misch metal and preferably up to about 0.75 wt% misch metal up to about 2% misch metal. In Zn 27% Al alloys about 1% misch metal (containing 50% Ce) is preferred.

EXAMPLE 1

A series of 20–30 lb. lots of Zn 27% Al were melted in air in a 100 KVA induction furnace and sufficient misch metal (50% Ce) to provide 0%, 0.3%, 0.6%, 1% and 2% misch metal in the final composition was added as a master alloy. The alloys were cast, at a temperature of 600° C. into a series of 2 inch, 3 inch and 6 inch diameter 8 inch long sand moulds. The castings were shaken out, sectional longitudinally and visually examined for porosity and shrinkage. The results are tabulated in Table 1.

EXAMPLE 2

A series of 20 lb. lots of Zn 40% Al were melted in air in a 100 KVA induction furnace and sufficient misch metal (50% Ce) to provide 0%, 1% and 2% misch metal in the final composition was added in the form of a master alloy. The alloys were cast, at a temperature of about 600° C. into a series of 2 inch and 3 inch diameter 8 inch long sand moulds. The castings were shaken out, sectional longitudinally and visually examined for porosity and shrinkage. The results are tabulated in Table 1.

TABLE 1

| Alloy | 2 Inch Dia. Casting | 3 Inch Dia. Casting | 6 Inch Dia. Casting |
|---|---|---|---|
| Zn 27 Al | general underside shrinkage | general underside shrinkage | |
| Zn 27 Al plus 0.3% mischmetal | localized underside shrinkage | localized underside shrinkage | |
| Zn 27 Al plus 0.6% mischmetal | virtually sound casting | minor underside porosity | |
| Zn 27 Al plus 1% mischmetal | sound casting | sound casting | |
| Zn 27 Al plus 2% mischmetal | sound casting | sound casting | sound casting |
| Zn 40 Al | general underside shrinkage | general underside shrinkage and porosity | |
| Zn 40 Al plus 1% mischmetal | localized underside shrinkage | localized underside shrinkage | |
| Zn 40 Al plus 2% mischmetal | sound casting | sound casting | |

We claim:

1. A method for controlling underside shrinkage in a cast hypereutectic zinc-aluminum alloy containing at least about 20 wt% aluminum comprising melting said alloy and adding thereto at least one rare earth metal in an amount between 0.25 wt% and 2.0 wt% and sufficient to substantially eliminate underside shrinkage when said alloy is cast into a sand mould having a cross section of at least one inch, and subsequently casting said rare earth metal containing alloy into a mould.

2. A method as claimed in claim 1 wherein misch metal is added to said alloy to thereby introduce said at least one rare earth metal.

3. A castable, hypereutectic zinc-aluminum alloy consisting essentially of:

at least 20 wt% to about 40 wt% aluminum
from 0.25 wt% to 2 wt% of at least one rare earth metal
up to 5.0 wt% Cu
up to 1.0 wt% Si
up to 0.1 wt% Mg
balance zinc and incidental impurities.

4. An alloy as claimed in claim 3 wherein said at least one rare earth metal is misch metal.

5. An alloy as claimed in claim 4 wherein said misch metal contains about 50% cerium.

6. An alloy as claimed in claim 4 wherein said misch metal contains about 5.0% Ce
3.8% La
4% Nd
4% Pr
and 1% other rare earth metals.

7. An alloy as claimed in claim 4 wherein said misch metal is present in an amount from 0.25 wt% to about 0.75 wt%.

8. An alloy as claimed in claim 4 containing about 27 wt% aluminum, about 1.0 wt% rare earth metal, balance zinc and incidental impurities.

* * * * *